US006251236B1

(12) United States Patent
Stevens

(10) Patent No.: US 6,251,236 B1
(45) Date of Patent: Jun. 26, 2001

(54) CATHODE CONTACT RING FOR ELECTROCHEMICAL DEPOSITION

(75) Inventor: Joe Stevens, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/201,486

(22) Filed: Nov. 30, 1998

(51) Int. Cl.[7] ..... C25D 17/00
(52) U.S. Cl. ..... 204/224 R; 204/279; 204/297.01
(58) Field of Search ..... 204/297 R, 297 W, 204/224 R, 279

(56) References Cited

U.S. PATENT DOCUMENTS

| | | | | |
|---|---|---|---|---|
| 4,364,816 | * | 12/1982 | Birt | 204/297 W |
| 4,428,815 | | 1/1984 | Powell et al. | 204/297 W |
| 4,435,266 | | 3/1984 | Johnston | 204/276 |
| 5,222,310 | | 6/1993 | Thompson et al. | 34/202 |
| 5,224,504 | | 7/1993 | Thompson et al. | 134/155 |
| 5,230,743 | | 7/1993 | Thompson et al. | 134/32 |
| 5,377,708 | | 1/1995 | Bergman et al. | 134/105 |
| 5,429,733 | | 7/1995 | Ishida | 204/224 R |
| 5,620,581 | * | 4/1997 | Ang | 204/297 R |
| 5,807,469 | * | 9/1998 | Crafts et al. | 204/297 W |
| 5,997,701 | * | 12/1999 | Bock | 204/297 R |
| 6,071,388 | * | 6/2000 | Uzoh | 204/224 R |
| 6,080,291 | * | 6/2000 | Woodruff et al. | 204/297.01 X |

FOREIGN PATENT DOCUMENTS

| | | |
|---|---|---|
| 58182823 | 10/1983 | (JP) . |
| 63118093 | 5/1988 | (JP) . |
| 04131395 | 5/1992 | (JP) . |
| 04280993 | 10/1992 | (JP) . |
| 6017291 | 1/1994 | (JP) . |
| WO 97/12079 | 4/1997 | (WO) . |
| WO 99/25904 | 5/1999 | (WO) . |
| WO 99/25905 | 5/1999 | (WO) . |

OTHER PUBLICATIONS

Peter Singer, "Tantalum, Copper and Damascene: The Future of Interconnects," Semiconductor International, Jun. 1998, pp. cover, 91–92, 94, 96 & 98.
Peter Singer, "Wafer Processing," Semiconductor International, Jun. 1998, p. 70.
Kenneth E. Pitney, "NEY Contact Manual," Electrical Contacts for Low Energy Uses, 1973 (No Month).
Ragnar Holm, "Electric Contacts Theory and Application," 4th Ed., 1967, (No Month).
PCT International Search Report dated Feb. 7, 2000.

* cited by examiner

*Primary Examiner*—Donald R. Valentine
(74) *Attorney, Agent, or Firm*—Thomason, Moser & Patterson LLP

(57) ABSTRACT

The present invention provides a cathode contact ring for use in an electroplating cell. The contact ring comprises an insulative body having a substrate seating surface and one or more conducting members disposed in the insulative body. The conducting members provide discrete conducting pathways and are defined by inner and outer conducting pads linked by conducting members. A power supply is attached to the conducting members to deliver current and voltage to a substrate during processing. The substrate seating surface comprises an isolation gasket extending diametrically interior to the inner conducting pads such that electrolyte is prevented from depositing on the backside of the substrate. The insulative body provides seating surfaces for other cell components, such as the lid, so that no additional insulating material is needed to isolate the components. A portion of the insulative body is disposed through a plurality of holes formed in the conducting framework. The holes provide increased integration and, consequently, increased strength and durability of the contact ring.

37 Claims, 7 Drawing Sheets

CATHODE CONTACT RING FOR ELECTROCHEMICAL DEPOSITION

BACKGROUND OF THE INVENTION

1. Field of the Invention

The present invention generally relates to deposition of a metal layer onto a substrate. More particularly, the present invention relates to an apparatus used in electroplating a metal layer onto a substrate.

2. Background of the Related Art

Sub-quarter micron, multi-level metallization is one of the key technologies for the next generation of ultra large scale integration (ULSI). The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die.

As circuit densities increase, the widths of vias, contacts and other features, as well as the dielectric materials between them, decrease to less than 250 nanometers, whereas the thickness of the dielectric layers remains substantially constant, with the result that the aspect ratios for the features, i.e., their height divided by width, increases. Many traditional deposition processes, such as physical vapor deposition (PVD) and chemical vapor deposition (CVD), have difficulty filling structures where the aspect ratio exceed 4:1, and particularly where it exceeds 10:1. Therefore, there is a great amount of ongoing effort being directed at the formation of void-free, nanometer-sized features having high aspect ratios wherein the ratio of feature height to feature width can be 4:1 or higher. Additionally, as the feature widths decrease, the device current remains constant or increases, which results in an increased current density in the feature.

Elemental aluminum (Al) and its alloys have been the traditional metals used to form lines and plugs in semiconductor processing because of aluminum's perceived low electrical resistivity, its superior adhesion to silicon dioxide ($SiO_2$), its ease of patterning, and the ability to obtain it in a highly pure form. However, aluminum has a higher electrical resistivity than other more conductive metals such as copper, and aluminum also can suffer from electromigration leading to the formation of voids in the conductor.

Copper and its alloys have lower resistivities than aluminum and significantly higher electromigration resistance as compared to aluminum. These characteristics are important for supporting the higher current densities experienced at high levels of integration and increase device speed. Copper also has good thermal conductivity and is available in a highly pure state. Therefore, copper is becoming a choice metal for filling sub-quarter micron, high aspect ratio interconnect features on semiconductor substrates.

Despite the desirability of using copper for semiconductor device fabrication, choices of fabrication methods for depositing copper into very high aspect ratio features, such as a 4:1, having $0.35\mu$ (or less) wide vias are limited. Precursors for CVD deposition of copper are ill-developed, and physical vapor deposition into such features produces unsatisfactory results because of voids formed in the features.

As a result of these process limitations, plating which had previously been limited to the fabrication of lines on circuit boards, is just now being used to fill vias and contacts on semiconductor devices. Metal electroplating is generally known and can be achieved by a variety of techniques. A typical method generally comprises physical vapor depositing a barrier layer over the feature surfaces, physical vapor depositing a conductive metal seed layer, preferably copper, over the barrier layer, and then electroplating a conductive metal over the seed layer to fill the structure/feature. Finally, the deposited layers and the dielectric layers are planarized, such as by chemical mechanical polishing (CMP), to define a conductive interconnect feature.

Plating is achieved by delivering power to the seed layer and then exposing the substrate plating surface to an electrolytic solution containing the metal to be deposited, such as copper. The seed layer provides good adhesion for the subsequently deposited metal layers, as well as a conformal layer for even growth of the metal layers thereover. However, a number of obstacles impairs consistently reliable electroplating of copper onto substrates having nanometer-sized, high aspect ratio features. Generally, these obstacles include providing uniform power distribution and current density across the substrate plating surface to form a metal layer having uniform thickness.

One current method for providing power to the plating surface uses contact pins which contact the substrate seed layer. Present designs of cells for electroplating a metal on a substrate are based on a fountain plater configuration. FIG. 1 is a cross sectional view of a simplified fountain plater 10 incorporating contact pins. Generally, the fountain plater 10 includes an electrolyte container 12 having a top opening, a substrate holder 14 disposed above the electrolyte container 12, an anode 16 disposed at a bottom portion of the electrolyte container 12 and a contact ring 20 contacting the substrate 48. The contact ring 20, shown in detail in FIG. 2, comprises a plurality of contact pins 56 distributed about the peripheral portion of the substrate 48 to provide a bias thereto. Typically, the contact pins 56 consist of a conductive material such as tantalum (Ta), titanium (Ti), platinum (Pt), gold (Au), copper (Cu), or silver (Ag). The plurality of contact pins 56 extend radially inwardly over the edge of the substrate 48 and contact a conductive seed layer of the substrate 48 at the tips of the contact pins 56. The pins 56 contact the seed layer at the extreme edge of the substrate 48 to minimize the effect of the pins 56 on the devices to be ultimately formed on the substrate 48. The substrate 48 is positioned above the cylindrical electrolyte container 12, and electrolyte flow impinges perpendicularly on the substrate plating surface during operation of the cell 10.

The contact ring 20, shown in FIG. 2, provides electrical current to the substrate plating surface 54 to enable the electroplating process. Typically, the contact ring 20 comprises a metallic or semi-metallic conductor. Because the contact ring is exposed to the electrolyte, conductive portions of the contact ring 20, such as the pins 56, accumulate plating deposits. Deposits on the contact ring 20, and particularly the pins 56, changes the physical and chemical characteristics of the conductor and eventually deteriorates the contact performance, resulting in plating defects due to non-uniform current distribution on the surface be plated. Efforts to minimize unwanted plating include covering the contact ring 20 and the outer surface of pins 56 with a non-plating or insulation coating.

However, while insulation coating materials may prevent plating on the outer pin surface, the upper contact surface remains exposed. Thus, after extended use of the fountain plater, solid deposits are inevitably formed on the pins. Because the deposits each have unique geometric profiles and densities, they produce varying contact resistance from pin to pin at the interface of the contact pins and seed layer resulting in a non-uniform distribution of current densities across the substrate. Also, the contact resistance at the pin/seed layer interface may vary from substrate to substrate, resulting in inconsistent plating distribution between different substrates using the same equipment. Furthermore, the plating rate tends to be increased near the region of the contact pins and is dissipated at further distances therefrom. A fringing effect of the electrical field also occurs at the edge of the substrate due to the localized electrical field emitted by the contact pins, causing a higher deposition rate near the edge of the substrate where the pin contact occurs.

The unwanted deposits are also a source of contamination and create potential for damage to the substrate. The deposits effectively bond the substrate and the pins to one another during processing. Subsequently, when the substrates are removed from the fountain plater, the bond between the pins and the substrate must be broken. Breaking the substrate loose leads to particulate contamination and requires force which may damage the substrate.

The fountain plater 10 in FIG. 1 also suffers from the problem of backside deposition. Because the contact pins 56 only shield a small portion of the substrate surface area, the electrolyte is able to communicate with the backside of the substrate and deposit thereon. Backside deposition may lead to undesirable results such as particulate becoming lodged in device features during post-plating handling as well as subsequent contamination of system components.

Therefore, there remains a need for an apparatus for delivering a uniform electrical power distribution to a substrate surface in an electroplating cell to deposit reliable and consistent conductive layers on substrates. It would be preferable to minimize or eliminate plating on the apparatus as well as the backside of the substrate.

SUMMARY OF THE INVENTION

The invention generally provides an apparatus for use in electro-chemical deposition of a uniform metal layer onto a substrate. More specifically, the invention provides a cathode contact ring for delivering electrical power to a substrate surface. The contact ring is electrically connected to a power supply and comprises a contact portion to electrically contact a peripheral portion of the substrate surface. In one embodiment, the contact portion comprises discrete conducting areas, such as contact pads, disposed on a substrate seating surface to provide continuous or substantially continuous electrical contact with the peripheral portion of the substrate. The invention provides a uniform distribution of power to a substrate deposition surface by providing a uniform current density across the substrate deposition surface through the contact pads. The invention also prevents process solution contamination of the backside of the substrate by providing a seal between the contact portion of the contact ring and the substrate deposition surface.

Another aspect of the invention provides an apparatus for holding a substrate during electro-chemical deposition comprising a contact ring having a conductive substrate seating surface electrically connected to a power supply. The contact ring has a plurality of conducting members to electrically contact a peripheral portion of the substrate surface. Preferably, the apparatus comprises a vacuum chuck having a substrate supporting surface to the substrate thereto.

Yet another aspect of the invention provides an apparatus for holding a substrate during electro-chemical deposition comprising a contact ring having conductive contact pads electrically connected to a power supply. The contact ring has a plurality of conducing members embedded in an insulative body to electrically contact a peripheral portion of the substrate surface. In one embodiment, the insulative body is annular and comprises a flange and parallel substrate seating surface connected by a sloping shoulder portion. The conducting members may comprise of a plurality of inner contact pads disposed on the substrate seating surface coupled to a plurality of outer contact pads disposed on the flange. Discrete circuits are arranged by coupling the power supply to each outer contact pad in parallel. An isolation gasket located at a diametrically interior portion of the contact ring seals the conducting contact pads and the substrate backside from the electrolytic solution.

Yet another aspect of the present invention is a contact ring constructed using a plurality of conducting members having holes formed therein. The conducting members are surrounded by an insulating material which is allowed to flow through the holes during manufacturing thereby achieving enhanced strength and durability. The conducting members are substantially embedded in the insulative material and have an exposed inner conducting surface which provides current to a substrate.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
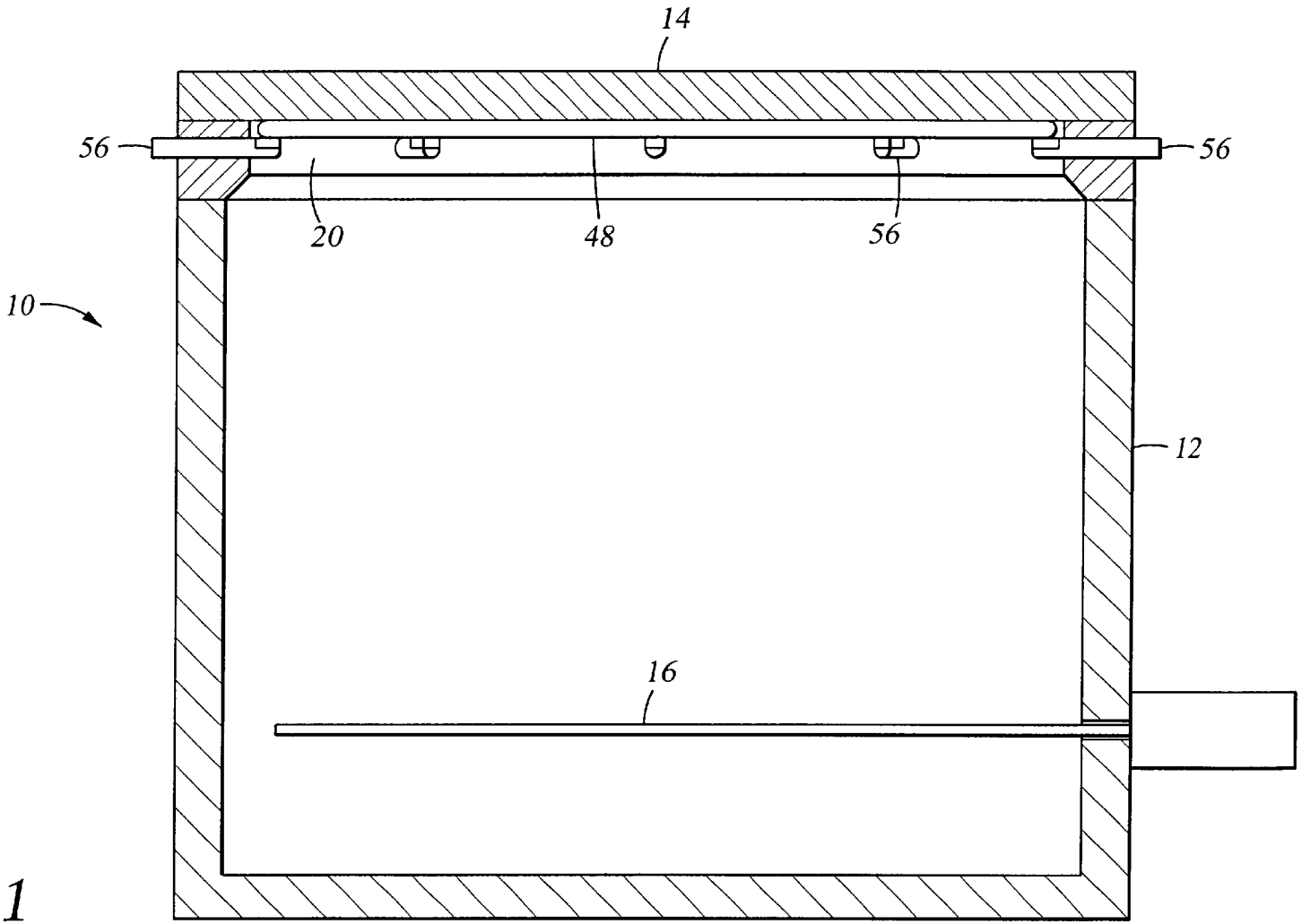
Fig. 1 (PRIOR ART)
FIG. 1 is a cross sectional view of a simplified prior art fountain plater.
Figure 2:
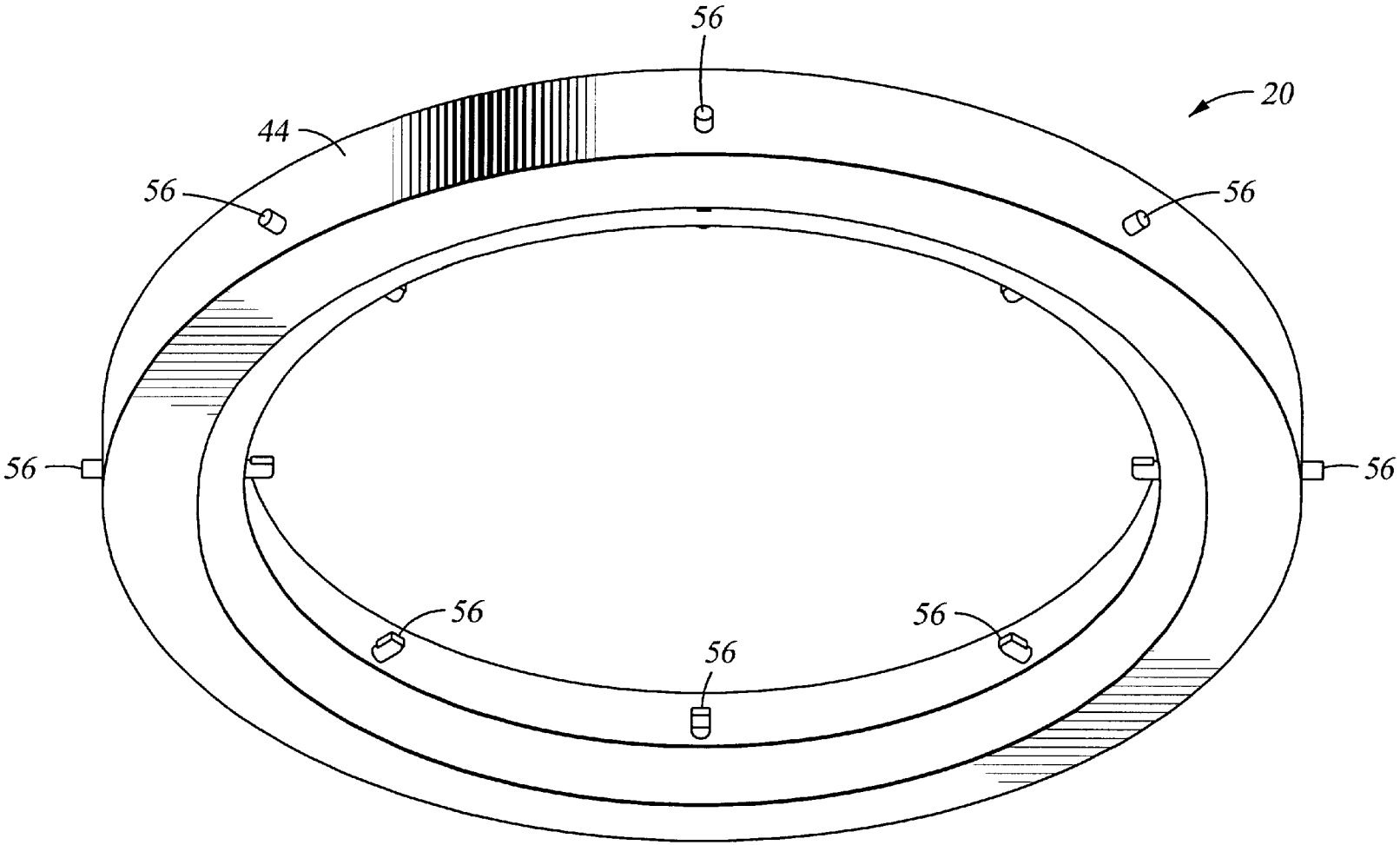
Fig. 2 (PRIOR ART)
FIG. 2 is a top view of a prior art cathode contact ring having a plurality of contact pins.
Figure 3:
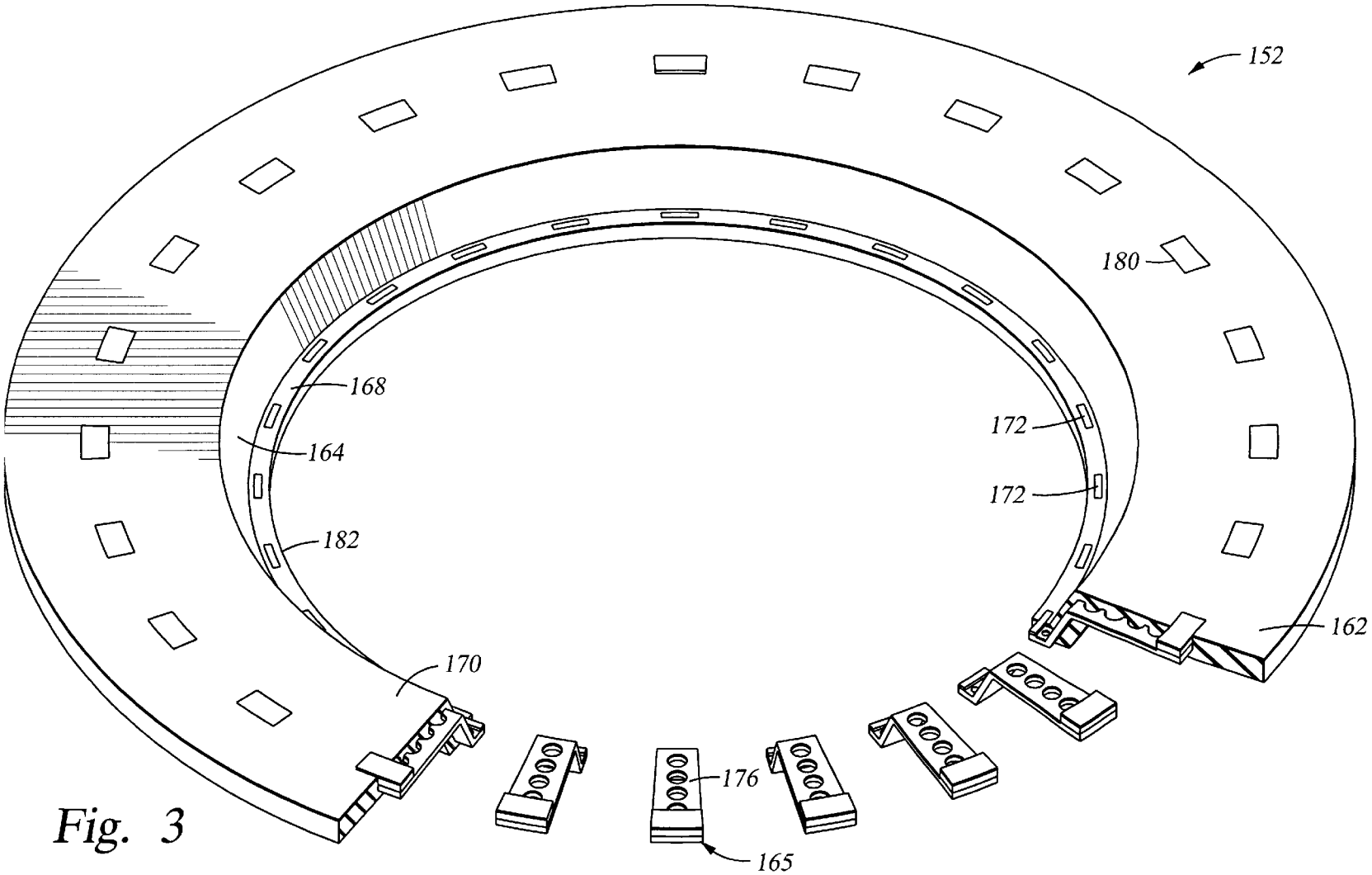
FIG. 3 is a partial cross sectional perspective view of a cathode contact ring.

FIG. 3 is a cross sectional view of one embodiment of a cathode contact ring 152 of the present invention. In general, the contact ring 152 comprises an annular body having a plurality of conducting members disposed thereon. The annular body is constructed of an insulating material to electrically isolate the plurality of conducting members. Together the body and conducting members form a diametrically interior substrate seating surface which, during processing, supports a substrate and provides a current thereto.

Referring now to FIG. 3 in detail, the contact ring 152 generally comprises a plurality of conducting members 165 at least partially disposed within an annular insulative body 170. The insulative body 170 is shown having a flange 162 and a downward sloping shoulder portion 164 leading to a substrate seating surface 168 located below the flange 162 such that the flange 162 and the substrate seating surface 168 lie in offset and substantially parallel planes. Thus, the flange 162 may be understood to define a first plane while the substrate seating surface 168 defines a second plane parallel to the first plane wherein the shoulder 164 is disposed between the two planes. However, contact ring design shown in FIG. 3 is intended to be merely illustrative. In another embodiment, the shoulder portion 164 may be of a steeper angle including a substantially vertical angle so as to be substantially normal to both the flange 162 and the substrate seating surface 168. Alternatively, the contact ring 152 may be substantially planar thereby eliminating the shoulder portion 164. However, for reasons described below, a preferred embodiment comprises the shoulder portion 164 shown in FIG. 3 or some variation thereof.

The conducting members 165 are defined by a plurality of outer electrical contact pads 180 annularly disposed on the flange 162, a plurality of inner electrical contact pads 172 disposed on a portion of the substrate seating surface 168, and a plurality of embedded conducting connectors 176 which link the pads 172, 180 to one another. The conducting members 165 are isolated from one another by the insulative body 170 which may be made of a plastic such as polyvinylidenefluoride (PVDF), perfluoroalkoxy resin (PFA), Teflon™, (polytetrafluorethylene or PTFE fluoropolymer) and Tefzel™, (ethylene-tetraflouroethylene or ETFE flouropolymer) or any other insulating material such as Alumina ($Al_2O_3$) or other ceramics. The outer contact pads 180 are coupled to a power supply (not shown) to deliver current and voltage to the inner contact pads 172 via the connectors 176 during processing. In turn, the inner contact pads 172 supply the current and voltage to a substrate by maintaining contact around a peripheral portion of the substrate. Thus, in operation the conducting members 165 act as discrete current paths electrically connected to a substrate.

Low resistivity, and conversely high conductivity, are directly related to good plating. To ensure low resistivity, the conducting members 165 are preferably made of copper (Cu), platinum (Pt), tantalum (Ta), titanium (Ti), gold (Au), silver (Ag), stainless steel or other conducting materials. Low resistivity and low contact resistance may also be achieved by coating the conducting members 165 with a conducting material. Thus, the conducting members 165 may, for example, be made of copper (resistivity for copper is approximately $2\times10^{-8}$ Ω·m) and be coated with platinum (resistivity for platinum is approximately $10.6\times10^{-8}$ Ω·m). Coatings such as tantalum nitride (TaN), titanium nitride (TiN), rhodium (Rh), Au, Cu, or Ag on a conductive base materials such as stainless steel, molybdenum (Mo), Cu, and Ti are also possible. Further, since the contact pads 172, 180 are typically separate units bonded to the conducting connectors 176, the contact pads 172, 180 may comprise one material, such as Cu, and the conducting members 165 another, such as stainless steel. Either or both of the pads 172, 180 and conducting connectors 176 may be coated with a conducting material. Additionally, because plating repeatability may be adversely affected by oxidation which acts as an insulator, the inner contact pads 172 preferably comprise a material resistant to oxidation such as Pt, Ag, or Au.

Figure 4:
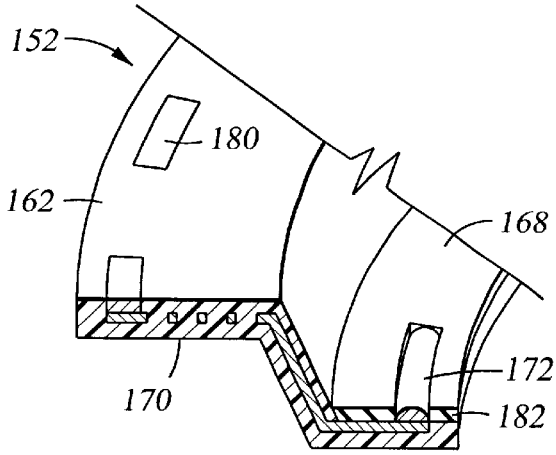
FIG. 4 is a cross sectional perspective view of the cathode contact ring showing an alternative embodiment of contact pads.
Figure 5:
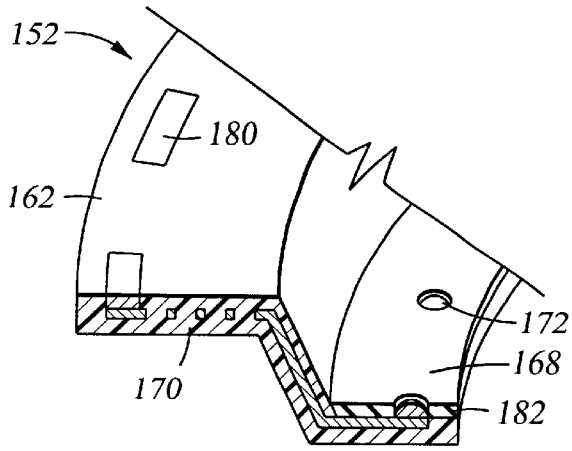
FIG. 5 is a cross sectional perspective view of the cathode contact ring showing an alternative embodiment of the contact pads and an isolation gasket.

In addition to being a function of the contact material, the total resistance of each circuit is dependent on the geometry, or shape, of the inner contact inner contact pads 172 and the force supplied by the contact ring 152. These factors define a constriction resistance, $R_{CR}$, at the interface of the inner contact pads 172 and the substrate seating surface 168 due to asperities between the two surfaces. Generally, as the applied force is increased the apparent area is also increased. The apparent area is, in turn, inversely related to $R_{CR}$ so that an increase in the apparent area results in a decreased $R_{CR}$. Thus, to minimize overall resistance it is preferable to maximize force. The maximum force applied in operation is limited by the yield strength of a substrate which may be damaged under excessive force and resulting pressure. However, because pressure is related to both force and area, the maximum sustainable force is also dependent on the geometry of the inner contact pads 172. Thus, while the contact pads 172 may have a flat upper surface as in FIG. 3, other shapes may be used to advantage. For example, two preferred shapes are shown in FIGS. 4 and 5. FIG. 4 shows a knife-edge contact pad and FIG. 5 shows a hemispherical contact pad. A person skilled in the art will readily recognize other shapes which may be used to advantage. A more complete discussion of the relation between contact geometry, force, and resistance is given in *Ney Contact Manual*, by Kenneth E. Pitney, The J. M. Ney Company, 1973, which is hereby incorporated by reference in its entirety.

Figure 6:
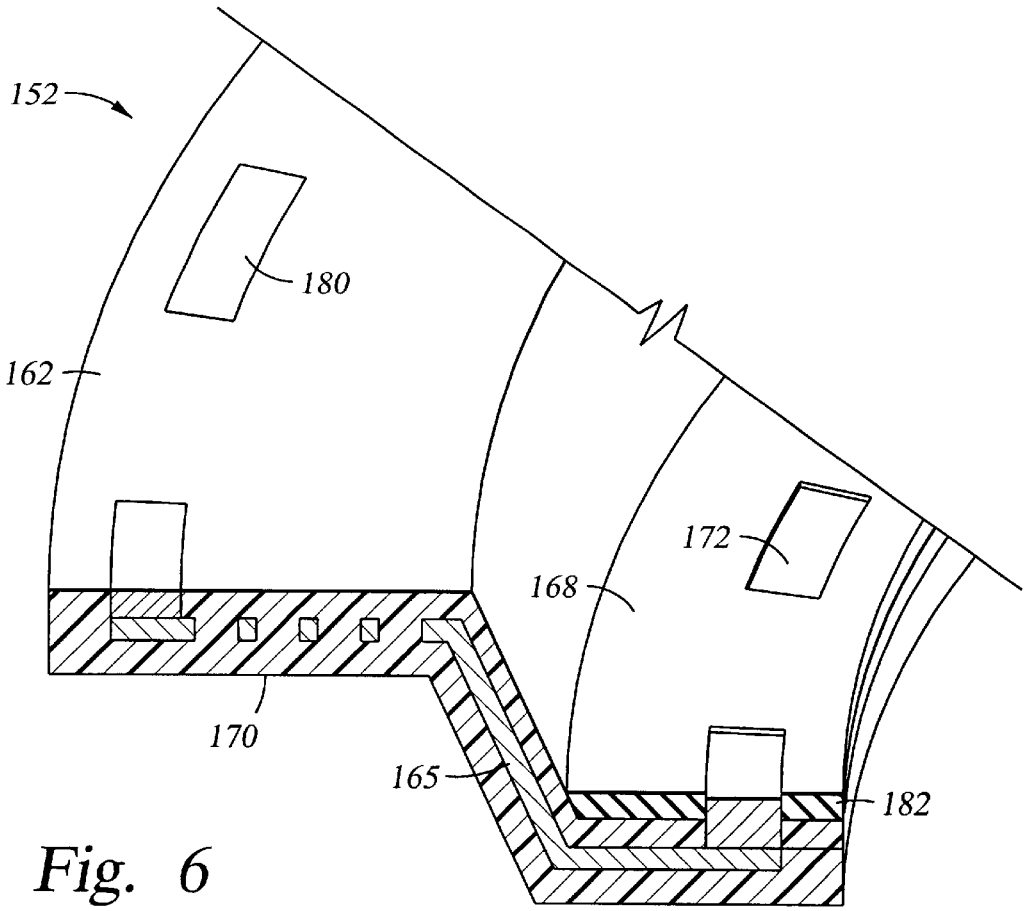
FIG. 6 is a cross sectional perspective view of the cathode contact ring showing the isolation gasket.

As shown in FIG. 6, the substrate seating surface 168 comprises an isolation gasket 182 disposed on the insulative body 170 and extending diametrically interior to the inner contact pads 172 to define the inner diameter of the contact ring 152. The isolation gasket 182 preferably extends slightly above the inner contact pads 172 (e.g., a few mils) and preferably comprises an elastomer such as Viton™, fluoroelastomer Teflon™, fluoropolymer buna rubber and the like. Where the insulative body 170 also comprises an elastomer the isolation gasket 182 may be of the same material. In the latter embodiment, the isolation gasket 182 and the insulative body 170 may be monolithic, i.e., formed as a single piece. However, the isolation gasket 182 is preferably separate from the insulative body 170 so that it may be easily removed for replacement or cleaning.

While FIG. 6 shows a preferred embodiment of the isolation gasket 182 wherein the isolation gasket is seated entirely on the insulative body 170, FIGS. 4 and 5 show an alternative embodiment. In the latter embodiment, the insulative body 170 is partially machined away to expose the upper surface of the connecting member 176 and the isolation gasket 182 is disposed thereon. Thus, the isolation gasket 182 contacts a portion of the connecting member 176. This design requires less material to be used for the inner contact pads 172 which may be advantageous where material costs are significant such as when the inner contact pads 172 comprise gold. Persons skilled in the art will recognize other embodiments which do not depart from the scope of the present invention.

During processing, the isolation gasket 182 maintains contact with a peripheral portion of the substrate plating surface and is compressed to provide a seal between the remaining cathode contact ring 152 and the substrate. The seal prevents the electrolyte from contacting the edge and backside of the substrate. As noted above, maintaining a clean contact surface is necessary to achieving high plating repeatability. Previous contact ring designs did not provide consist plating results because contact surface topography varied over time. The contact ring of the present invention eliminates, or least minimizes, deposits which would otherwise accumulate on the inner contact pads 172 and change their characteristics thereby producing highly repeatable, consistent, and uniform plating across the substrate plating surface.

Figure 7:
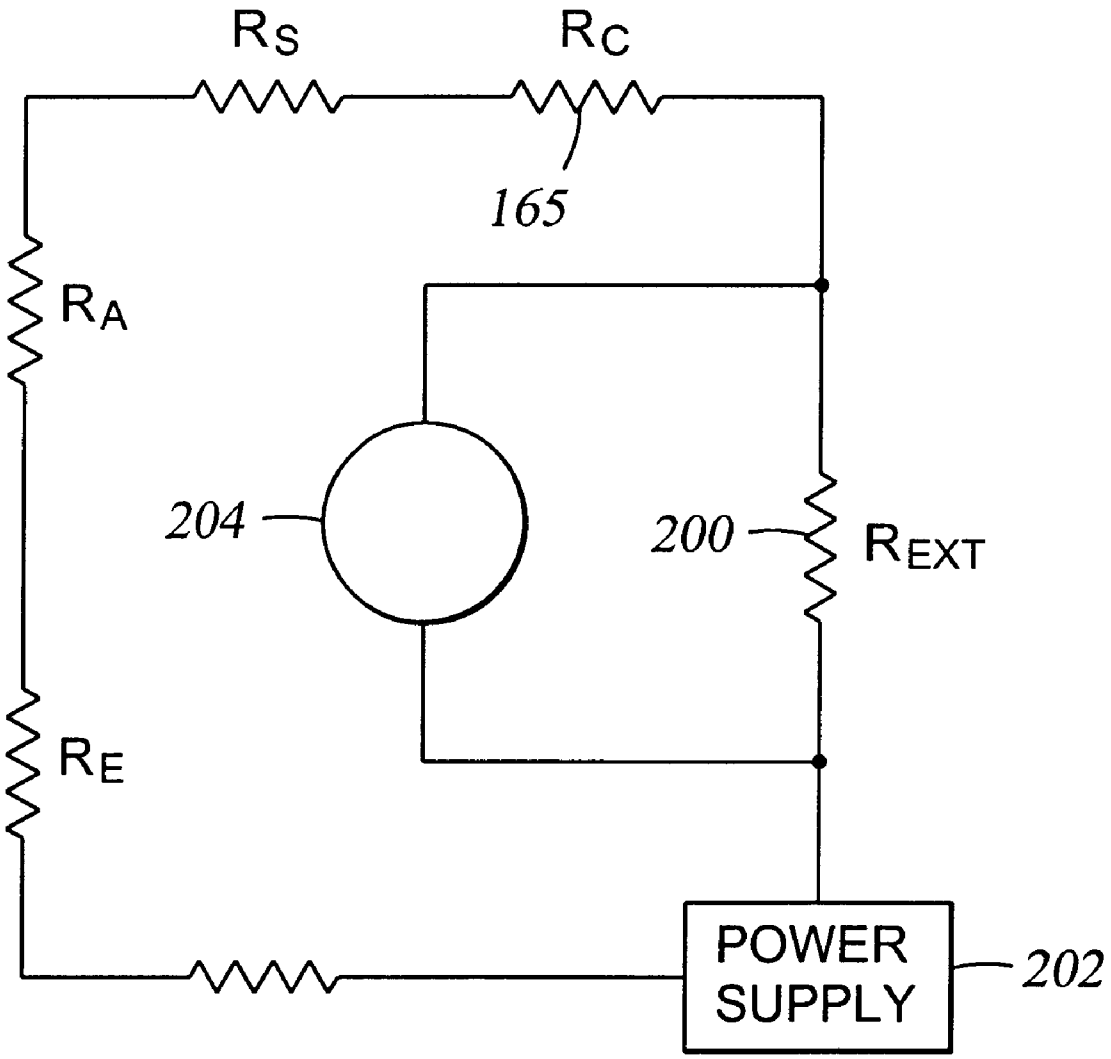
FIG. 7 is a simplified schematic diagram of the electrical circuit representing the electroplating system through each contact pin.

FIG. 7 is a simplified schematic diagram representing a possible configuration of the electrical circuit for the contact ring 152. To provide a uniform current distribution between the conducting members 165, an external resistor 200 is connected in series with each of the conducting members 165. Preferably, the resistance value of the external resistor 200 (represented as $R_{EXT}$) is much greater than the resistance of any other component of the circuit. As shown in FIG. 4, the electrical circuit through each conducting member 165 is represented by the resistance of each of the components connected in series with the power supply 202. $R_E$ represents the resistance of the electrolyte, which is typically dependent on the distance between the anode and the cathode contact ring and the composition of the electrolyte chemistry. Thus, $R_A$ represents the resistance of the electrolyte adjacent the substrate plating surface 154. $R_S$ represents the resistance of the substrate plating surface 154, and $R_C$ represents the resistance of the cathode conducting members 165 plus the constriction resistance resulting at the interface between the inner contact pads 172 and the substrate plating layer 154. Generally, the resistance value of the external resistor ($R_{EXT}$) is at least as much as $\Sigma R$ (where $\Sigma R$ equals the sum of $R_E$, $R_A$, $R_S$ and $R_C$). Preferably, the resistance value of the external resistor ($R_{EXT}$) is much greater than $\Sigma R$ such that $\Sigma R$ is negligible and the resistance of each series circuit approximates $R_{EXT}$.

Typically, one power supply is connected to all of the outer contact pads 180 of the cathode contact ring 152, resulting in parallel circuits through the inner contact pads 172. However, as the inner contact pad-to-substrate interface resistance varies with each inner contact pad 172, more current will flow, and thus more plating will occur, at the site of lowest resistance. However, by placing an external resistor in series with each conducting member 165, the value or quantity of electrical current passed through each conducting member 165 becomes controlled mainly by the value of the external resistor. As a result, the variations in the electrical properties between each of the inner contact pads 172 do not affect the current distribution on the substrate, and a uniform current density results across the plating surface which contributes to a uniform plating thickness. The external resistors also provide a uniform current distribution between different substrates of a process-sequence.

Although the contact ring 152 of the present invention is designed to resist deposit buildup on the inner contact pads 172, over multiple substrate plating cycles the substrate-pad interface resistance may increase, eventually reaching an unacceptable value. An electronic sensor/alarm 204 can be connected across the external resistor 200 to monitor the voltage/current across the external resistor to address this problem. If the voltage/current across the external resistor 200 falls outside of a preset operating range that is indicative of a high substrate-pad resistance, the sensor/alarm 204 triggers corrective measures such as shutting down the plating process until the problems are corrected by an operator. Alternatively, a separate power supply can be connected to each conducting member 165 and can be separately controlled and monitored to provide a uniform current distribution across the substrate. A very smart system (VSS) may also be used to modulate the current flow. The VSS typically comprises a processing unit and any combination of devices known in the industry used to supply and/or control current such as variable resistors, separate power supplies, etc. As the physiochemical, and hence electrical, properties of the inner contact pads 172 change over time, the VSS processes and analyzes data feedback. The data is compared to pre-established setpoints and the VSS then makes appropriate current and voltage alterations to ensure uniform deposition.

Figure 8C:
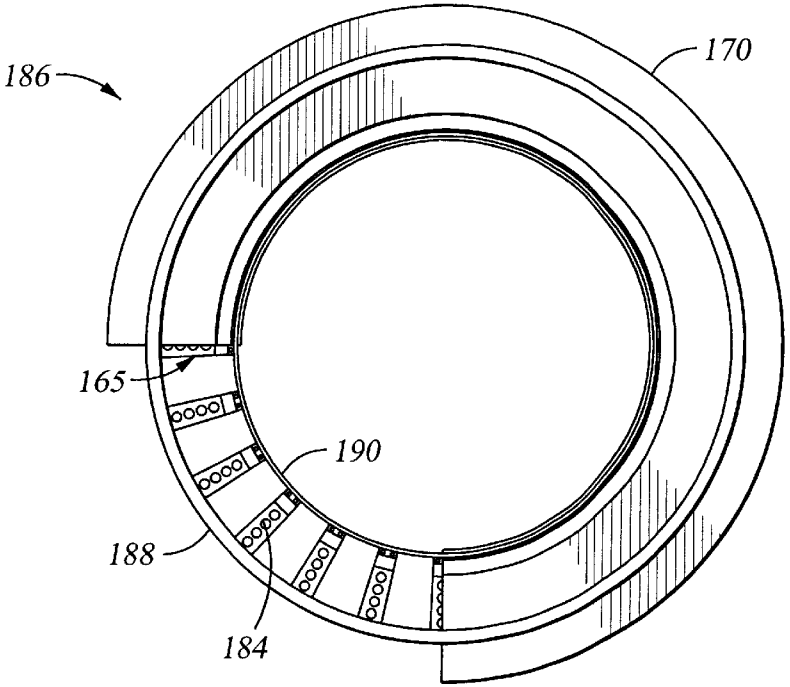
FIG. 8*c* is a top cutaway view of the cathode contact ring.
Figure 8A:
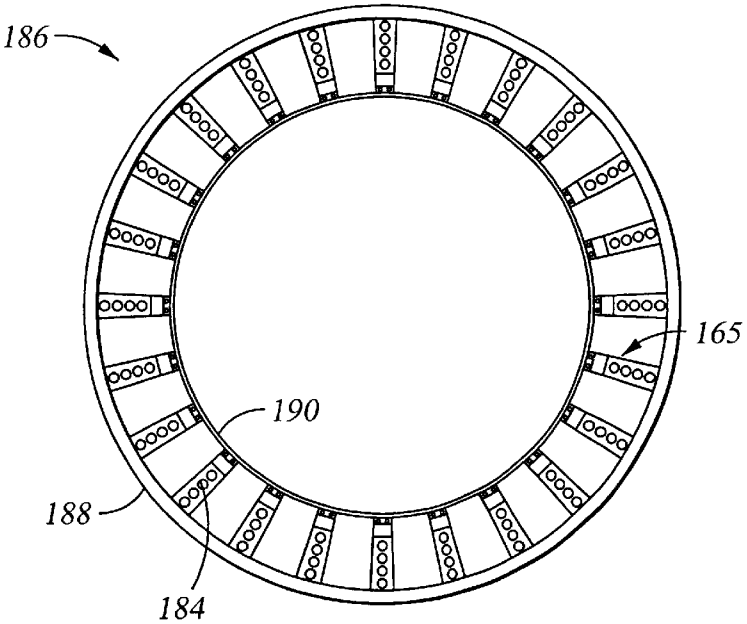
FIG. 8*a* is a top view of the cathode contact ring conducting frame.
Figure 8B:
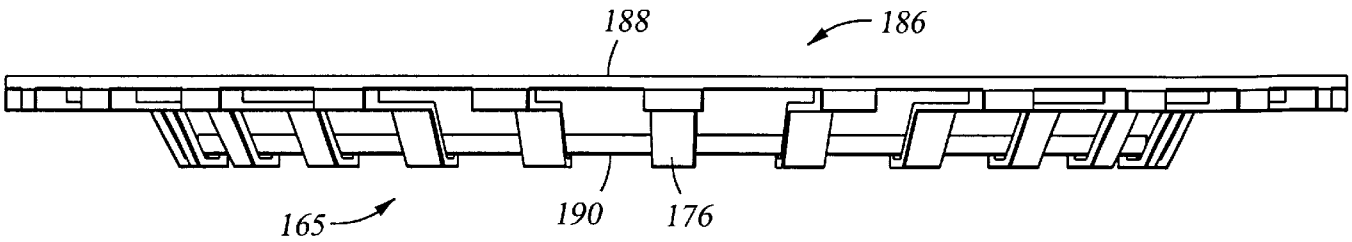
FIG. 8*b* is a partial cross section of the cathode contact ring conducting frame.

Referring now to FIGS. 8*a*–8*c*, the construction of the contact ring 152 will be discussed. FIGS. 8*a* and 8*b* show a top view and partial cross sectional view, respectively, of a conducting frame 186 in its initial state before the insulative body 170 (shown in FIG. 8*c*) is formed, or otherwise disposed, thereon. The frame 186 consists of an inner conducting ring 188 and a concentric outer conducting ring 190. The rings 188, 190 are connected at intervals by the conducting connectors 176. The number of connectors 176 may be varied depending on the particular number of contact pads 172 (shown in FIG. 3) desired. For a 200 mm substrate, preferably at least twenty-four connectors 176 are spaced equally over 360° C. However, as the number of connectors reaches a critical level, the compliance of the substrate relative to the contact ring 152 is adversely affected. Therefore, while more than twenty-four connectors 176 may be used, contact uniformity may eventually diminish depending on the topography of the contact pads 172 and the substrate stiffness. Similarly, while less than twenty-four connectors 176 may be used, current flow is increasingly restricted and localized, leading to poor plating results. Since the dimensions of the present invention are readily altered to suit a particular application (for example, a 300 mm substrate), the optimal number may easily be determined for varying scales and embodiments.

A fluid insulating material is then molded around the frame 186 and allowed to cool and harden to form the insulative body 170. The material of the insulative body 170 is allowed to flow through a plurality of holes 184 formed in the conducting connectors 176 in order to achieve enhanced strength, durability, and integration. The upper surface of the insulative body 170 is then planarized such that the upper surfaces of the conducting rings 188, 190 are exposed, as shown in the top cutaway view of FIG. 8*c*. The individual contact pads 172, 180 (shown in FIG. 3) are formed by machining away a portion of the conducting rings 188, 190 and insulative body 170 until the connecting members are removed and thus exposing discrete pads 165 encapsulated in the insulating material. Thus, the completed contact ring 152 consists of discrete current paths (consisting of the contact pads 172, 180 and the connectors 176) adapted to provide a current to a substrate deposition surface. Alternatively, either or both of the conducting rings 188, 190 may be left intact. For example, the outer ring 188 may provide a single unbroken outer conducting surface while the unbroken inner ring 190 may define a solid inner conducting surface to provide maximum surface contact with a substrate plating surface. While the contact pads 172, 180 and the connectors 176 are treated here as discrete units, they may alternatively comprise a monolithic structure, e.g., formed as a single unit. A person skilled in the art will recognize other embodiments.

Figure 9:
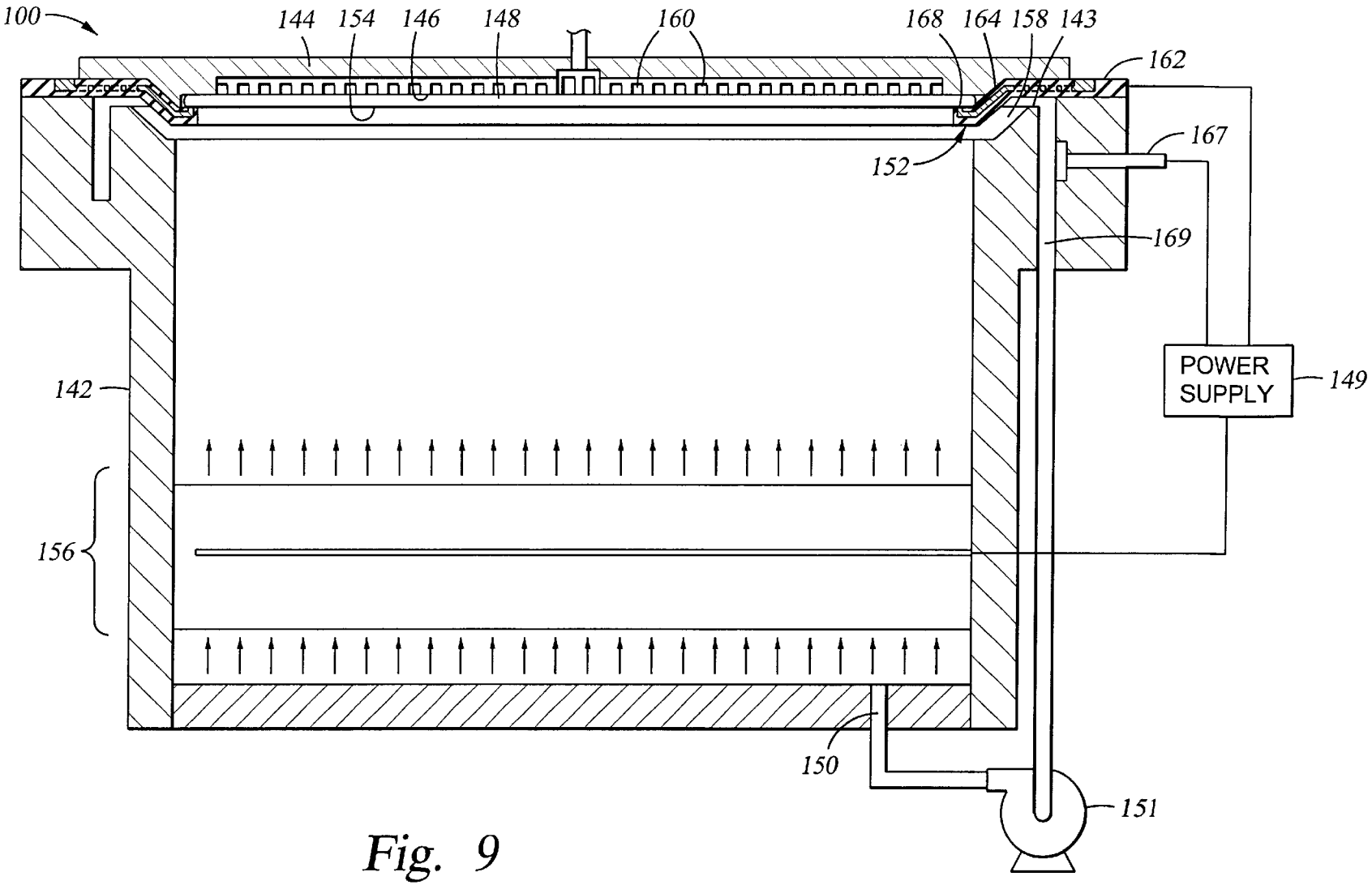
FIG. 9 is a partial cut-away perspective view of an electro-chemical deposition cell showing the interior components of the electro-chemical deposition cell.

FIG. 9 is a partial vertical cross sectional schematic view of a cell 100 for electroplating a metal onto a substrate incorporating the present invention. The electroplating cell 100 generally comprises a container body 142 having an opening on the top portion of the container body 142 to receive and support a lid 144. The container body 142 is preferably made of an electrically insulative material such as a plastic. The lid 144 serves as a top cover having a substrate supporting surface 146 disposed on the lower portion thereof. A substrate 148 is shown in parallel abutment to the substrate supporting surface 146. The container body 142 is preferably sized and shaped cylindrically in order to accommodate the generally circular substrate 148 at one end thereof. However, other shapes can be used as well. As shown in FIG. 9, an electroplating solution inlet 150 is disposed at the bottom portion of the container body 142. The electroplating solution is pumped into the container body 142 by a suitable pump 151 connected to the inlet 150 and flows upwardly inside the container body 142 toward the substrate 148 to contact the exposed substrate plating surface 154. In one aspect, a consumable anode 156 is disposed in the container body 142 to provide a metal source in the electrolyte.

The container body 142 includes an egress gap 158 bounded at an upper limit by the shoulder 164 of the cathode contact ring 152 and leading to an annular weir 143 substantially coplanar with (or slightly above) the substrate seating surface 168 and thus the substrate plating surface 154. The weir 143 is positioned to ensure that the plating surface 154 is in contact with the electrolyte when the electrolyte is flowing out of the electrolyte egress gap 158 and over the weir 143. Alternatively, the upper surface of the weir 143 is positioned slightly lower than the substrate plating surface 154 such that the plating surface 154 is positioned just above the electrolyte when the electrolyte overflows the weir 143, and the electrolyte contacts the substrate plating surface 154 through meniscus properties (i.e., capillary force).

During processing, the substrate 148 is secured to the substrate supporting surface 146 of the lid 144 by a plurality of vacuum passages 160 formed in the surface 146 and connected at one end to a vacuum pump (not shown). The cathode contact ring 152 shown disposed between the lid 144 into the container body 142 is connected to a power supply 149 to provide power to the substrate 148. The contact ring 152 has a perimeter flange 162 partially disposed through the lid 144, a sloping shoulder 164 conforming to the weir 143, and an inner substrate seating surface 168 which defines the diameter of the substrate plating surface 154. The shoulder 164 is provided so that the inner substrate seating surface 168 is located below the flange 162. This geometry allows the substrate plating surface 154 to come into contact with the electrolyte before the solution flows into the egress gap 158 as discussed above. However, as noted above, the contact ring design may be varied from that shown in FIG. 9 without departing from the scope of the present invention. Thus, the angle of the shoulder portion 164 may be altered or the shoulder portion 164 may be eliminated altogether so that the contact ring is substantially planar. Where a planar design is used seals may be disposed between the contact ring 152, the container body 142 and/or the lid 144 to form a fluid tight seal therebetween.

The substrate seating surface 168 preferably extends a minimal radial distance inward below a perimeter edge of the substrate 148, but a distance sufficient to establish electrical contact with a metal seed layer on the substrate deposition surface 154. The exact inward radial extension of the substrate seating surface 168 may be varied according to application. However, in general this distance is minimized so that a maximum deposition surface 154 surface is exposed to the electrolyte. In a preferred embodiment, the radial width of the seating surface 168 is 2 mm from the edge.

In operation, the contact ring 152 is negatively charged to act as a cathode. As the electrolyte is flowed across the substrate surface 154, the ions in the electrolytic solution are attracted to the surface 154. The ions then impinge on the surface 154 to react therewith to form the desired film. In addition to the anode 156 and the cathode contact ring 152, an auxiliary electrode may be used to control the shape of the electrical field over the substrate plating surface 154. An auxiliary electrode 167 is shown here disposed through the container body 142 adjacent an exhaust channel 169. By positioning the auxiliary electrode 167 adjacent to the exhaust channel 169, the electrode 167 able to maintain contact with the electrolyte during processing and affect the electrical field.

While foregoing is directed to the preferred embodiment of the present invention, other and further embodiments of the invention may be devised without departing from the basic scope thereof, and the scope thereof is determined by the claims that follow.

What is claimed is:

1. A cathode contact ring for use in an electroplating cell apparatus, the contact ring comprising:

(a) an annular insulative body defining a central opening;

(b) an isolation gasket disposed on the annular insulative body and defining a circumferential substrate seating surface; and (c) one or naore conducting members at least partially disposed integrally in the insulative body and defining a portion of the substrate seating surface, wherein at least a portion of the isolation gasket is disposed diametrically interior to the one or more conducting members.

2. The contact ring of claim 1, wherein the isolation gasket and the insulative body comprise a monolithic piece.

3. The contact ring of claim 1, wherein the one or more conducting members comprise one or more connectors having a plurality of holes.

4. The contact ring of claim 1, wherein the one or more conducting members comprise a conducting coating selected from the group consisting of copper (Cu), platinum (Pt), tantalum (Ta), titanium (Ti), gold (Au), silver (Ag), rhodium (Rh), stainless steel, and any combination thereof.

5. The contact ring of claim 1, wherein the insulative body comprises an insulating material.

6. The contact ring of claim 1, wherein the insulating material is selected from the group consisting of polyvinylidenefluoride (PVDF), perfluoroalkoxy resin (PFA), polytetrafluorethylene (PTFE fluoropolymer), ethylenetetrafluoroethylene (ETFE fluoropolymer), Alumina ($Al_2O_3$), ceramic, and any combination thereof.

7. The contact ring of claim 1, wherein the isolation gasket is removable.

8. The contact ring of claim 1, wherein the isolation gasket comprises an elastomer.

9. The contact ring of claim 1, wherein the elastomer is selected from the group consisting of fluoroelastomer, buna rubber, polytetrafluorethylene (PTFE fluoropolymer), and any combination thereof.

10. The contact ring of claim 1, wherein the conducting members are attached to a power supply.

11. The contact ring of claim 1, further comprising:

(d) a power supply connected to each of the one or more conducting members; and (e) one or more external resistors connected to each of the one or more conducting members and to the power supply, wherein each of the one or more external resistors comprises a first resistance greater than a second resistance of each of the one or more conducting members.

12. The contact ring of claim 1, wherein the one or more conducting members comprise:

(i) an outer conducting surface;

(ii) an inner conducting surface disposed on the substrate seating surface; and (iii) a plurality of conducting connectors radially disposed through the insulative body which electrically link the outer conducting surface to the inner conducting surface.

13. The contact ring of claim 12, wherein the inner conducting surface comprises one or more inner contact pads.

14. The contact ring of claim 12, wherein the insulative body further comprises a sloped shoulder disposed between the outer conducting surface and the inner conducting surface, such that the outer conducting surface and the inner conducting surface are offset.

15. The contact ring of claim 14, wherein the insulative body further comprises a flange having the outer conducting surface disposed thereon.

16. The contact ring of claim 12, further comprising a power supply coupled to the outer conducting surface.

17. The contact ring of claim 16, wherein the outer conducting surface comprises one or more outer contact pads and wherein the power supply is connected to each of the one or more outer contact pads.

18. The contact ring of claim 17, wherein the inner conducting surface comprises one or more inner contact pads.

19. The contact ring of claim 1, wherein the one or more conducting members comprise a conducting material.

20. The contact ring of claim 19, wherein the conducting material is selected from the group consisting essentially of copper (Cu), platinum (Pt), tantalum (Ta), tantalum nitride (TaN), titanium nitride (TiN), titanium (Ti), gold (Au), silver (Ag), stainless steel, and any combination thereof.

21. An apparatus for electroplating a substrate, comprising:

(a) an electroplating cell body;

(b) a lid disposed at an upper end of the body;

(c) an anode disposed at a lower end of the body;

(d) a cathode contact ring at least partially disposed within the cell body adjacent the lid, the cathode contact ring comprising:

(i) an insulative body comprising an inner conducting surface located inside the cell body and an outer conducting surface;

(ii) a plurality of conducting connectors at least partially disposed integrally in the insulative body to electrically link the outer conducting surface and the inner conducting surface; and (iii) an isolation gasket disposed on the insulative body and defining a circumferential substrate seating surface, wherein at least a portion of the isolation gasket is disposed diametrically interior to the inner conducting surface; and (e) at least one power supply coupled to the outer conducting surface.

22. The apparatus of claim 21, further comprising:

(f) one or more external resistors connected between the one or more conducting connectors and the power supply, wherein each of the one or more external resistors comprises a first resistance greater than a second resistance of each of the one or more conducting members.

23. The apparatus of claim 21, wherein the isolation gasket and the insulative body comprise a monolithic piece.

24. The apparatus of claim 21, wherein the isolation gasket is removable.

25. The apparatus of claim 21, wherein the one or more conducting members comprise one or more connectors having a plurality of holes.

26. The apparatus of claim 21, wherein the one or more conducting members comprise a conducting coating selected from the group consisting of copper (Cu), platinum (Pt), tantalum (Ta), titanium (Ti), gold (Au), silver (Ag), rhodium (Rh), stainless steel, and any combination thereof.

27. The apparatus of claim 21, wherein the one or more conducting members comprise a conducting material.

28. The apparatus of claim 27, wherein the conducting material is selected from the group consisting of copper (Cu), platinum (Pt), tantalum (Ta), tantalum nitride (TaN), titanium nitride (TiN), titanium (Ti), gold (Au), silver (Ag), stainless steel, and any combination thereof.

29. The apparatus of claim 21, wherein the isolation gasket comprises an elastomer.

30. The apparatus of claim 29, wherein the elastomer is selected from the group consisting of fluoroelastomer, buna rubber, polytetrafluorethylene (PTFE fluoropolymer), and any combination thereof.

31. The apparatus of claim 21, wherein the insulative body comprises an insulating material.

32. The apparatus of claim 31, wherein the insulating material is selected from the group consisting essentially of polyvinylidenefluoride (PVDF), perfluoroalkoxy resin (PFA), polytetrafluorethylene (PTFE fluoropolymer), ethylene-tetrafluoroethylene (ETFE fluoropolymer, Alumina ($Al_2O_3$), ceramic, and any combination thereof.

33. The apparatus of claim 21, wherein the insulative body further comprises a sloped shoulder disposed between the outer conducting surface and the inner conducting surface such that the inner conducting surface and the outer conducting surface are offset.

34. The apparatus of claim 33, further comprising an egress gap defined by the cell body and the contact ring.

35. The apparatus of claim 21, wherein the outer conducting surface comprises one or more outer contact pads.

36. The apparatus of claim 35, wherein each pad of the one or more outer contact pads is connected to a separate power supply.

37. The apparatus of claim 35, wherein the inner conducting surface comprises one or more inner contact pads.

* * * * *

UNITED STATES PATENT AND TRADEMARK OFFICE

CERTIFICATE OF CORRECTION

PATENT NO. : 6,251,236 B1
DATED : June 26, 2001
INVENTOR(S) : Stevens

It is certified that error appears in the above-identified patent and that said Letters Patent is hereby corrected as shown below:

Column 7,
Line 6, please replace "consist" with -- consistent --.

Column 10,
Line 31, please replace "naore" with -- more --.

Signed and Sealed this

Twenty-sixth Day of February, 2002

*Attest:*

*Attesting Officer*

JAMES E. ROGAN
*Director of the United States Patent and Trademark Office*